United States Patent [19]

Scott et al.

[11] Patent Number: 4,969,063

[45] Date of Patent: Nov. 6, 1990

[54] CIRCUIT BREAKER WITH STATUS INDICATING LIGHTS

[75] Inventors: Gary W. Scott, Mount Vernon; Christopher K. Goble, Marion, both of Iowa

[73] Assignee: Square D Company, Palatine, Ill.

[21] Appl. No.: 352,434

[22] Filed: May 16, 1989

[51] Int. Cl.[5] ..... G08B 21/00

[52] U.S. Cl. ..... 361/93; 335/17; 340/638; 340/642; 200/310; 200/317

[58] Field of Search ..... 361/91.88, 93, 102, 361/114; 340/641, 642, 652, 638, 660; 335/17; 337/79

[56] References Cited

U.S. PATENT DOCUMENTS

| | | | |
|---|---|---|---|
| 3,529,292 | 9/1970 | Neill et al. | 340/163 |
| 3,683,350 | 8/1972 | Shedenheim | 340/638 |
| 3,742,402 | 6/1973 | Nicol et al. | 335/17 |
| 3,742,403 | 6/1973 | Nicol | 335/17 |
| 3,999,176 | 12/1976 | Kellogg et al. | 340/253 |
| 4,250,476 | 2/1981 | Evans et al. | 335/17 |
| 4,358,810 | 11/1982 | Wafer et al. | 361/93 |
| 4,611,201 | 9/1986 | Guim et al. | 340/638 |
| 4,633,240 | 12/1986 | Guim et al. | 340/638 |
| 4,652,867 | 3/1987 | Masot | 340/638 |
| 4,691,197 | 9/1987 | Damiano et al. | 340/638 |

*Primary Examiner*—Todd E. DeBoer

*Attorney, Agent, or Firm*—Jose W. Jimenez

[57] ABSTRACT

A three-condition constantly illuminated status indicator is provided in a circuit breaker to provide three luminesce displays indicating that the breaker is in the on, off or tripped condition. Associated electrical circuitry employs diode-steered capacitive charging elements for selective, common or simultaneous energization of a three-color light emitting diode display without acting as a bypass around the circuit breaker, thus eliminating shock hazard. Selective energization of the light emitting elements is achieved by auxiliary switching means operable to a plurality of switching conditions according to switching conditions of the circuit breaker. The capacitors serve as an impedance to current for the light emitting diodes, eliminating the need for ballasting resistors, resulting in a cooler operating, lower power consumption unit.

12 Claims, 4 Drawing Sheets

FIG. 2
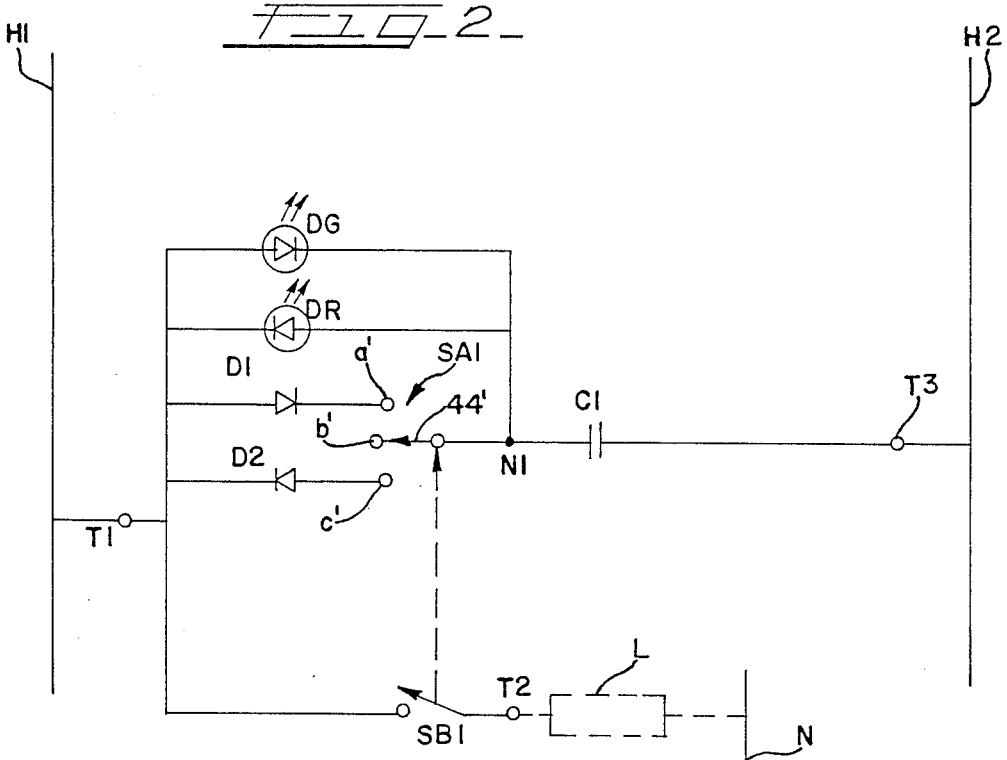
FIG. 2a
| SWITCHING | | EXCITATION | |
|---|---|---|---|
| SB1 | SA1 | DG | DR |
| ON | POLE a' | OFF | ON |
| OFF | POLE c' | ON | OFF |
| TRIP | POLE b' | ON | ON |
FIG. 3
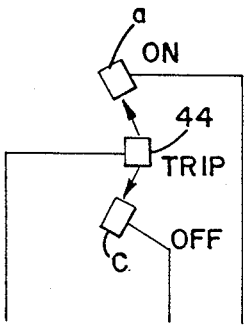

FIG. 4
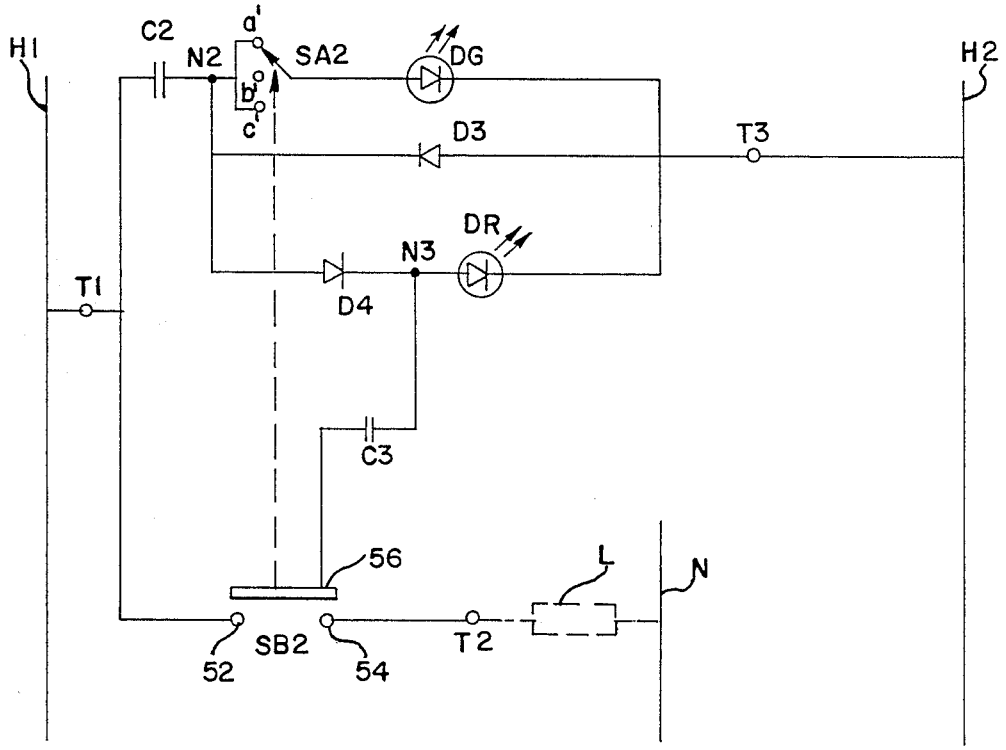
FIG. 4a
| SWITCHING | | EXCITATION | |
|---|---|---|---|
| SB2 | SA2 | DG | DR |
| ON | ON-a' | ON | ON |
| OFF | ON-c' | ON | OFF |
| TRIP | OFF-b' | OFF | ON |
FIG. 5
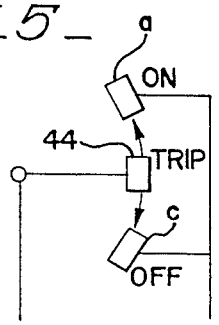

| SWITCHING | | EXCITATION | |
|---|---|---|---|
| SB3 | SA3A/B/C | DG | DR |
| ON | POLES d''-a'' | OFF | ON |
| OFF | POLES c''-c'' | ON | OFF |
| TRIP | POLES b''-b'' | ON | ON |

CIRCUIT BREAKER WITH STATUS INDICATING LIGHTS

DESCRIPTION

1. Technical Field

The invention is related to an electrical circuit breaker operable between three status conditions and having means for displaying the status condition of the breaker.

2. Background Prior Art

The particular status of an electrical circuit breaker, i.e. on, manually turned off or automatically tripped, is not always easy to determine from the position of the associated actuating handle or button under certain situations. This is particularly true when available ambient light is low, or when the observer is some distance away from the breaker, or when the observer is inexperienced at using circuit breakers. It is important to know the status of a given circuit breaker for two reasons.

First, a service technician must always know before he starts working on an electrical load or appliance permanently connected to power circuit whether or not it is safe to do so. He must therefore be able to easily verify that the circuit breaker connecting the load in question is in the off condition.

Second, in those instances where several personnel are engaged in working or otherwise servicing the electrical equipment in the same area, frequently turning various breakers on or off, it is important that the electrician servicing troublesome equipment which is in the habit of tripping breakers be able to quickly establish that the equipment in question is inoperative because someone has turned off the breaker, or in the alternative that it has tripped the breaker because of defective equipment operation.

There remains a need for an indicator system which will show to a remote observer which switching conditions exist in the breaker. Additionally, any such indicator system must draw any necessary electrical power from incoming electrical power lines in such a way that it does not form a significant shunt paths around the breaker itself. Such shunt path can give rise to shock hazard, in that the user may attempt to change connections any point in the circuit protected by the breaker in the tripped or off state and still receive an electrical shock because of this bypassing action.

U.S. Pat. Nos. 4,633,240 and 4,611,201, both issued to Guim, et al., disclose a breaker having a battery-powered light energized through an auxiliary switch coupled to the breaker mechanism so as to turn the light on only when the breaker trips. Here an obvious hazard is presented since the light is extinguished in both the off and on settings of the breaker, and the electrician servicing remote equipment has to closely inspect the breaker to determine whether to handle indicates the ON or OFF condition.

U.S. Pat. No. 3,529,292 issued to Neill, et al. shows a system status indicator for an array of remote electrical loads and using a complex system of independent status lights indicating the load status and breaker settings; however, there is no provision for a status light indicating the off state of the load.

U.S. Pat. No. 4,691,197 issued to Damiano, et al. discloses a circuit for turning on a lamp only when a fuse blows.

U.S. Pat. No. 3,999,176 issued to Kellogg, et al. discloses a circuit breaker having a two-state warning light condition indicative of the closed and open states of a circuit breaker; however, there is no provision for indicating an intermediate tripped state.

U.S. Pat. No. 4,652,867 issued to Masot discloses a breaker-actuated light which illuminates when the breaker is tripped. The circuit disclosed therein has the property that the light emitting element is in parallel with the breaker switch, again thus having the previously mentioned undesirable feature that the load terminal is not completely isolated from input power lines when the breaker is in the tripped condition.

Ideally, a preferred circuit breaker would produce three uniquely different, readily visible indications of the switching state of the breaker, would be powered in such a way as not to shunt the breaker, and would not require a secondary power source such as batteries. Such a circuit breaker, drawing its power from incoming power lines, would thus produce a fourth state in the event that an upstream breaker were to open, namely no luminous output whatever from the display device. Moreover, any such control circuitry used for such selective energization of luminous display devices should be inexpensive, reliable, capable of being incorporated into a breaker housing, and preferably should not employ heat generating elements such as resistors to provide proper voltages or ballasting to the display units.

To date no completely satisfactory solution to this problem, knowledge has been provided. The invention is provided to solve these and other problems.

SUMMARY OF THE INVENTION

It is an object of the invention to provide a status condition indicator for a circuit breaker.

According to the invention, auxiliary switching means are incorporated into a breaker system to be automatically operable to a plurality of different switching conditions indicative of the status of the breaker. Associated control circuitry powered from incoming power lines and not connected to the breaker load terminal are governed by the status of the auxiliary switching system to energize a luminous display element to three different output conditions each condition indicative of a different switching condition of the breaker. In the preferred form of the invention the output takes the form of a tri-state indicator consisting of a red and a green light emitting diode, selective excitation of the individual diodes by the controlled circuitry producing a red or green light output, and simultaneous excitation of the two diodes providing a perceived orange display color. In some embodiments current limiting action is provided by steering diodes and capacitors in the control circuit so that the charge placed on a capacitor during a given half-cycle of alternating voltage will be delivered to an associated light emitting diode during the subsequent half-cycle. Selection of the capacitor size thus governs in a non-dissipative manner the delivery to the LED so energized.

Other features and advantages of the invention will be apparent from the following specification taken in conjunction with the following drawings.

BRIEF DESCRIPTION OF DRAWINGS

FIGS. 2 and 2*a* are a schematic diagram and table showing the switching states of a first embodiment of the control circuitry of the circuit breaker in FIG. 1 used to selectively, energize indicator lamps.

FIG. 3 is a schematic view of a wiper and contact arrangement used to govern the operation of the circuit shown in FIG. 2.

FIG. 4, and 4*a* are a second version of such control circuitry.

FIG. 5 is a schematic view of a wiper and contact switching assembly used to govern the operation of the circuit shown in FIG. 4.

DETAILED DESCRIPTION

Figure 1:
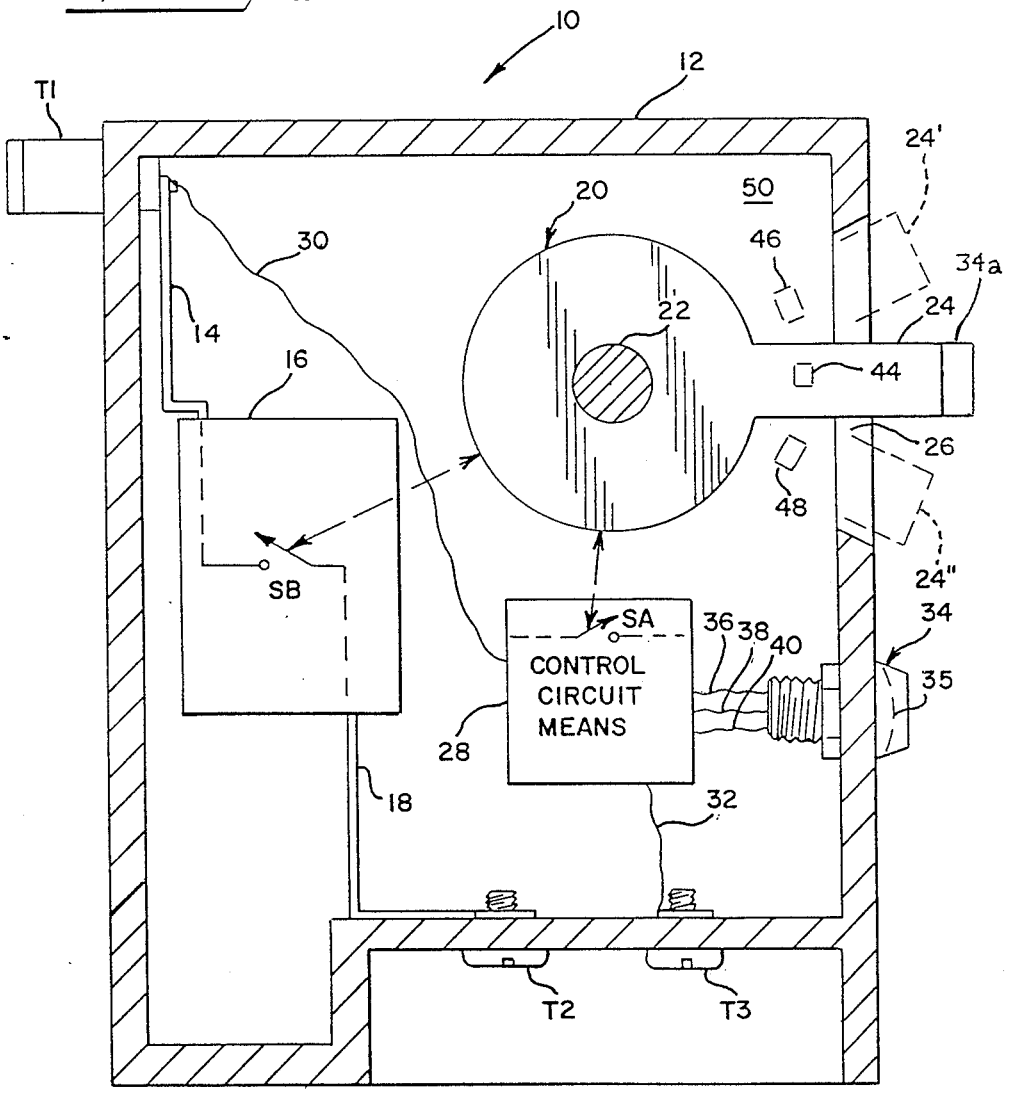
FIG. 1 is a partially cutaway schematic view of a circuit breaker containing control circuitry for selectively actuating indicator lamps to show the status of the circuit breaker.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring now to the figures, FIG. 1 shows in general schematic form elements of a breaker assembly 10 contained within a housing 12. Extending from the rear face of the housing is a blade-type terminal T1 configured to be plugged into a correspondingly configured buss connector terminal which is coupled to an incoming power line (not shown). Incoming power from the terminal T1 is led via a power lead 14 to an overload tripping element 16, here functionally represented as a breaker switch SB. The tripping element 16 may take a variety of forms well known in the art, and has the general property that it may be manually operated by mechanical linkages between closed and open conditions, and further that when in the closed condition it will automatically actuate to a "tripped" open-circuit condition in the event that an overcurrent passes therethrough.

Current passing through from the tripping element 16 is passed via a power lead 18 to a load terminal T2 configured for attachment to a chosen group of loads (not shown) serviced by the breaker assembly 10. Terminal T3 is used to make a connection to the neutral or alternatively to an incoming power line of a different phase or voltage than the line connected to T1. In an alternative version, the terminals T3 and T2 may be provided in a form having a blade-shaped configuration similar to input terminal T1.

A manual actuator 20 is provided in such assemblies, the actuator being rotatably mounted about an axle 22 fixed within the housing 12, and having affixed or otherwise coupled thereto a handle 24 extending outwardly through an aperture 26 in a front wall of the housing 12. The aperture 26 is configured with sufficient length to allow the handle 24 to be rotated through a range of positions. The manual actuator 20 and the breaker switch SB are operatively coupled so that forcing the handle 24 upward to its extreme position shown by the dotted boundary 24' (the ON position) will operate switch SB to a closed condition. Similarly, operation of the handle 24 to the lower position indicated by the dotted boundary 24'' will operate the switch SB to an open (OFF) condition. Interaction between the manual actuator 20 and the breaker switch SB is bilateral such that, with the actuator handle 24 in the ON position 24', when the current flowing through the tripping element 16 exceeds its rated value, the breaker switch SB will automatically actuate to an open circuit (tripped) condition, and this movement is communicated to the actuator 20 to bias the handle 24 to the center position shown in FIG. 1, thereby indicating to the observer that the unit has been tripped. The breaker assembly 10 is thereafter resetto the ON condition in most designs by rotating the handle 24 first to the open position indicated by the dotted boundary 24'' then to the ON position indicated by the dotted boundary 24'. This action resets a mechanical latch and permits closing the breaker switch SB.

To provide a luminous status-indicating display which will unambiguously show under poor lighting conditions all three breaker states, i.e., open, closed, and tripped, there is further provided control circuit means 28 including an auxiliary switching system SA (auxiliary switching means) operatively coupled to the tripping element 16, and adopting different switching configurations according to which of the three states the breaker assembly 10 adopts. Although the auxiliary switching system SA is shown as a simple single-pole-single-throw element in FIG. 1, it may take a variety of configurations, including multiple pole switch configurations.

Electrical power is supplied to the control circuit means 28 from a power lead 30 connected to terminal T1, thus supplying power from the power lines, and from a power lead 32 connected to an auxiliary terminal T3 optionally connected either to the neutral (return) line, or alternatively to the opposite high side of a 240 volt system supplying paired 120 volt single phase power distribution.

A three color light emitting diode (LED) unit 34 is mounted on the front wall of the housing 12. Such LED units 34 typically consist of a red and a green LED mounted behind a light-diffusing window 35. When only one LED is selectively energized the light coming from the window 35 will be either red or green; however, when both are energized the blending action of the window 35 causes an observer's eye to perceive the two colors as their additive complement, namely orange.

Selective excitation of these two LED's is provided via leads 36, 38, 40 connected to the control circuit 28. Thus, according to which of the three breaker states are relayed to the auxiliary switching system SA, namely open, closed, and tripped, the two LED's in the LED unit 34 will be excited singly (red or green), or commonly (red and green), thereby providing a clear indication of the state of the breaker assembly 10.

The auxiliary switching system SA may take a variety of forms. One such form incorporates a handle-position indicating switch. The switch is configured as a brush or wiper mounted on the actuator handle 24 shown in FIG. 1. Stationary metalization contact pads 46, 48 are affixed to a side wall of the housing 12 to confront and contact the wiper 44, and to selectively make contact thereto according to the position of the actuator handle 24. A pair of such pads are symbolically shown in the dotted outlines 46, 48. A variety of pad configurations and wiring interconnections therebetween may be employed as will be discussed with respect to various forms of associated circuitry. Suitable electrical leads are used to connect the contact pads 46, 48 and the wiper 44 to the control circuit to operate the LED unit 34. Such a wiper contacting system will be assumed for purposes of discussion of various forms of control circuit means 28; however, such particularizations are for explanatory purposes only, and the broad teachings of the present invention are not to be construed as to being so limited.

FIG. 2 shows one version of the control circuit 28. Electrical power is supplied via one high line H1 of a 240 volt system via terminal T1. The breaker switch SB, functionally shown in FIG. 1, is a single-pole single-throw switch SB1 coupled to operate an auxiliary switch SA1 configured as a single-pole three-position switch. As previously described, the switch SA1 is operatively coupled to be directly actuated according to the position of the actuator 20.

A representative layout of the metalization contact pads is shown in FIG. 3. Only two metalization pads a,c are required. The counterparts of pads a,c are shown in the schematic in diagram of FIG. 2 as poles a', c'. A center pole b' is not used for electrical connection, and thus no corresponding pad is necessary in the metalization diagram of FIG. 3. Thus when the actuator handle 24 (FIG. 1) is in the tripped position shown, no contact will be made between the wiper 44 and the contact pads a, b, in FIG. 3. When the handle 24 is in the ON position, contact is made between wiper 44 and the contact pad a, i.e. pole a' of switch SA1 is contacted. When the handle 24 is in the OFF position, contact will then be made between the wiper 44 and pad c (FIG. 3) i.e. to pole c' in FIG. 2.

FIG. 2*a* shows the switching states of breaker switch SB1 and auxiliary switch SA1 in the ON, OFF and tripped conditions, as well as the excitation of a green LED diode DG and a red LED diode DR joining the LED unit 34.

When the actuator 20 is in the ON position, switch SA1 is operated to contact pole a', thereby connecting a charging diode D1 to deliver an input charge from the 240 volt line H1 during "rising" voltage half-cyles, (i.e., the half-cycle beginning when terminal T1 is at its maximum negative value with respect to terminal T3) through node N1 to a capacitor C1 which is in turn connected to the opposite line H2 via terminal T3. During the next (i.e., "falling") half-cycles diode D1 is in a blocking condition, and capacitor C1 discharges through the anode of a red LED DR having its anode connected to node N1 and its cathode connected to terminal T1. It will be observed that the green LED DG, being connected in parallel but in opposite polarity to red LED DR is not actuated due to the shunting action of diode D1. When the actuator 20 is in the OFF position switch SA1 contacts pole c', so as to connect the anode of a diode D2 to node N1, the cathode of this diode being connected to line H1. Thus, with the breaker switch SB1 in the OFF position, capacitor C1 will be charged on falling half-cycles through diode D2 to place a negative potential at terminal N1, and during rising half-cycles the green LED DG will be selectively energized.

In the tripped position, diodes D1 and D2 are both disconnected, the diodes DG and DR are selectively energized on alternate half-cycles through capacitor C1, providing to the observer apparently simultaneous excitation of the red LED DR and the green LED DG, causing a composite orange color to be perceived.

The capacitor C1 is preferably 0.1 microfarads. Diodes D1 and D2 may, for example, be of the type IN4007. The LED elements DG and DR may, for example, be of the integrated two-diode type 521-9177 made by Dialight Corporation and designated as element 34 in FIG. 1. It will further be noted with respect to FIG. 2 that no additional ballasting resistors are necessary to guard against over-excitation of the LED elements DG, DR, this function in being accomplished by the expedient of adjusting capacitor C1 to the value given above.

FIG. 4 shows a second embodiment of the control circuit 28. Here the auxiliary switch SA2 has its outer poles a', c' connected together as shown in FIG. 5. Thus, switch SA2 conducts in both the ON and OFF conditions, but is in an open circuit condition in the tripped state. As in the previous example, input terminal T1 is connected to one of the high power lines H1 to deliver electrical power to breaker switch SB2 and therefrom to a load L via an output terminal T2. Here the breaker switch SB2 is configured as a "double break" unit, i.e. a breaker having two stationary poles 52, 54 and a movable bridging blade 56. Such "double break" units are frequently desirable in certain power applications.

LED excitation power is applied alternatively via a capacitor C2 connected between input terminal T1 and a node N2, and also via a capacitor C3 connected between the bridging blade 56 and a node N3. The node N3 joins the cathode of a silicon diode D4 with the anode of the red LED DR. The anode of diode D4 is in turn connected to node N2, and the cathode of the red LED DR is connected to output terminal T3, this output terminal again being connected to the other high side of the line H2. A second silicon diode D3 has its anode connected to terminal T3 and its cathode connected to node N2. The green LED DG has its cathode connected to terminal T3 and its anode connected to the rotor switch SA2. Interconnected outer poles a', c' of switch SA2 are connected to node N2.

FIG. 4*a* shows the switching and excitation states of the circuit of FIG. 4. When the breaker switch SB2 is in the ON position, switch SA2 is closed. On rising voltage half-cycles energizing current is delivered to the green LED DG via the capacitor C2 and to the red LED DR via capacitor C3.

When switch SB2 is in the OFF condition switch SA2 is once again in the ON position, but excitation is no longer supplied via capacitor C3. As before, on alternate half-cycles when line H1 is rising, the green LED DG will be energized through C2; however, this in turn will hold the voltage at node N2 at no more than approximately 2.3 volts positive with respect to output terminal T3. Because of the presence of the silicon diode D4 in series with the red LED DR, approximately 3.0 volts will have to be applied to the anode of diode D4 to energize the red LED DR. This is not available because of the shunting action of the green LED DG. Therefore, only the green LED DG is turned on.

When switch SB2 is in the tripped position the continuity through auxiliary switch SA2 is broken, removing the previously mentioned shunting effect, so that upon alternate half-cycles when line H1 is rising the red LED DR is energized. It will be noted on the falling half-cycles that capacitor C2 is charged to the opposite polarity from the silicon diode D3 having its anode connected to output terminal T3 and its cathode connected to N2. Upon subsequent falling of the line voltage, the stored charge will be delivered through diode D4 to the red LED DR. Capacitors C2 and C3 have the value 0.1 microfarad, the LED is of the type No. 521-9178, and diodes D3,D4 are both type IN 4007.

Figures 6, 6A:
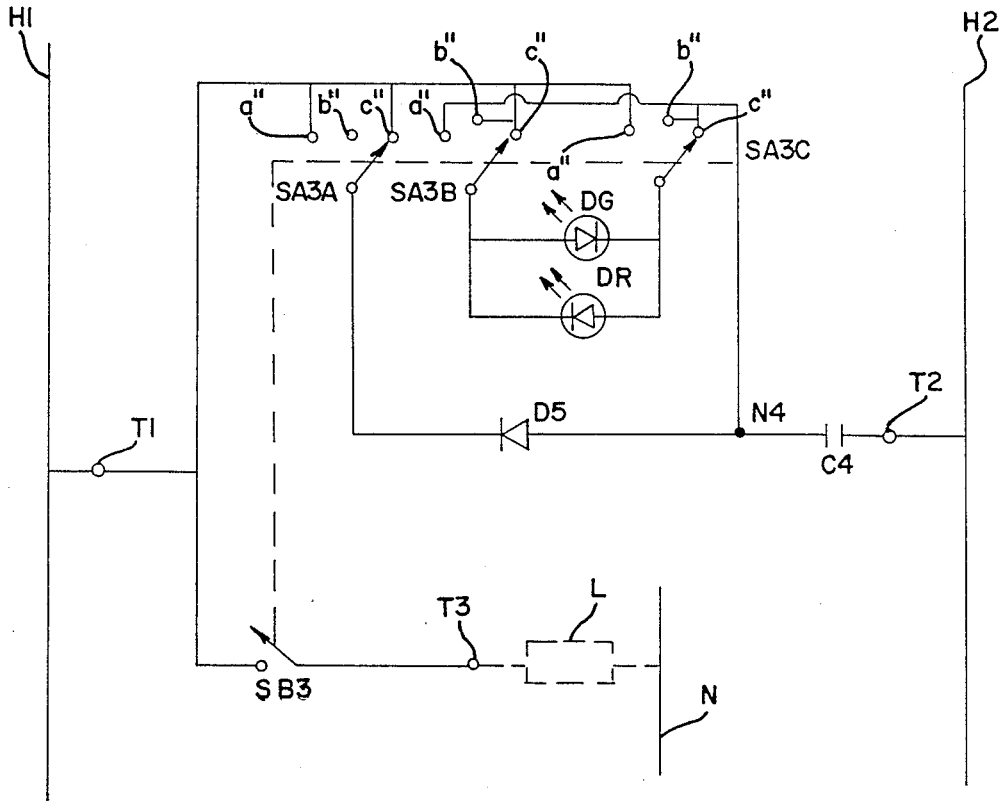
FIGS. 6 and 6*a* are a schematic circuit and table of the switching states third form of control circuitry.

FIG. 6 shows a third embodiment of the invention. Here the breaker switch SB3 is of the same general type shown in FIG. 2, i.e. a single-break switch. The auxiliary switching system consists of three tandem three-position switches SA3A, SA3B and SA3C. Each switch is simultaneously operated to one of three positions contacting its associated poles a″, b″ and c′, respectively. Pad locations would be similar to those shown in FIGS. 3 and 5; however, three such switching systems must be provided. In FIG. 6 it will be noted that switches SA3B and SA3C are simply connected as polarity reversing switches to reverse the polarity of excitation supplied to the oppositely connected parallel LED pair DR, DG connected between input terminal T1 and node N4, node N4 being connected through capacitor C4 to output power terminal T2, this terminal being again shown connected to the opposite line H2. With respect to diode D5, this element has its anode connected to node N4 and its cathode connected to the rotor of switch SA3A. It will be noted that switch SA3A is connected to input terminal T1 only in the ON and OFF positions of the breaker system. Thus, with the system in the ON position, the capacitor C4 charges on rising voltage half-cycles of line H1 through diode D5 and returns charge on the falling half-cycles through the red LED DR. In the OFF position the polarity supplied to the diode pair DG, DR is reversed, and charge from the capacitor C4 on discharge will flow through the green LED diode DG.

In the tripped position the diode pair DG, DR is still connected between input terminal T1 and node N4; however, diode D5 is now disconnected from the circuit. As a result the diodes DG, DR will be alternately excited through capacitor C4 on alternate half-cycles of the power line voltage, thus illuminating both elements when the system is in the tripped position. Capacitor C4 has a value of 0.1 microfarads, the LED pair is type No. 521-9177, and diode D5 is type IN4007.

It will be noted that all of the foregoing systems, although employing substantially different auxiliary switching mechanisms, are energized solely by connection between the input power lines H1, H2 and do not require connection to the load side of the circuit breaker, thereby eliminating the possible shock hazard previously referred. Further with respect to the circuit configurations shown, in each case the connection of the power terminal T2 may alternatively be made to the neutral line N. This will, however necessitate readjustment of the charging capacitor values. In most breaker installations; however, connections to the power buss lines H1, H2 is preferred simply because they are normally immediately accessible from the jaw points of the main circuit breaker servicing the installation.

With respect to the particular forms of auxiliary switching systems shown herein for purely illustrative purposes as a wiping contact system, it should be recognized that a great many functional equivalents may be employed. What is essential is that necessary switching states be realized. Thus, with respect to the circuit of FIG. 2, the overall requisite of switch SA1 is that it connect one of the LED's DG, DR when the breaker is in the ON position, and the other of the LED's when the breaker is in the OFF position, and that the switch be operated to an open-circuit condition when the breaker is in the tripped position. A great many switching systems and selective mechanical linkages may be utilized to accomplish this.

With respect to FIG. 4, all that is required of SA2 is that it be in the closed state when the breaker is in the ON and OFF states, and that it be in the open state when in the tripped state.

With respect to FIG. 6, switch SA3A must be closed when the breaker is in the ON and OFF states and must be open in the tripped state. Switches SA3B and SA3C may be taken in the form of any configuration which will serve the polarity reversing between input terminal T2 and node N4, according to whether the circuit breaker is in the ON or OFF condition, and which further will connect the diode pair DG, DR between these points when the breaker is in the tripped position. Additionally, it should be recognized that the light emitting diode assembly 34 shown in FIG. 1 may, if desired be incorporated into the handle 24 as assembly 34*a* as shown in FIG. 1.

Finally, it shoujld be recognized that equivalent means may be achieved to produce the requisite three different luminous display conditions. Thus, for example a shutter manually responsive to the state of the breaker assembly 10 may be interposed behind the light diffuser 35 (FIG. 1) to selectively cut off the light from the diodes. A representative circuit would be that of FIG. 2 with switch SA1 and diodes D1 and D2 removed.

While the invention has been described with reference to a preferred embodiment, it will be understood by those skilled in the art that various changes may be made and equivalents may be substituted for elements thereof without departing from the broader aspects of the invention.

What is claimed is:

1. A switching-condition-indicating status indicator for a circuit breaker operable automatically upon overload to a tripped switching condition and including breaker terminals adapted for connection to electrical power lines so as to interrupt the flow of electrical power to an associated load upon tripping of said breaker, said breaker including an actuator handle for resetting said breaker to a closed switching condition and thereafter between open and closed switching conditions, comprising:

detecting means for detecting all of said switching conditions of said breaker; and light emitting display means powered from said breaker terminals and responsive to said detecting means for providing three different display conditions visually indicating the switching condition of said breaker, said display means includes first and second light-emitting diodes producing different first and second output colors, only said first light-emitting diode being energizable when said breaker is in one of said breaker switching conditions, only said second light-emitting diode being energizable when said breaker is in another of said breaker switching conditions, and both of said light-emitting diodes being energizable when said breaker is in the remaining breaker switching conditions to provide first, second and third display conditions.

2. The status indicator of claim 1 wherein said detecting means and said display means are configured so as to isolate said input power lines from said load when said breaker is in said tripped and said open conditions.

3. The status indicator of claim 1 wherein said display means includes auxiliary switching system responsively coupled to said breaker and operable between at least two switching states according to the switching condition of said breaker, and an electrical network having network terminals adapted for connection to said power lines and configured to interconnect said auxiliary switching system and said display means, said network being configured to selectively activate said display means to said first, second, and third display conditions when said breaker is respectively in said tripped, open, and closed switching conditions, said network being disconnected from said associated load when said breaker is in said tripped and said open conditions.

4. The status indicator of claim 3 wherein said display means includes first and second light-emitting diodes producing different first and second output colors; and said network is configured to selectively energize said light-emitting diodes,

5. The status indicator of claim 4 wherein said light-emitting diodes are contained within a common diode housing, said housing having a light-transmitting window configured to diffuse the light output of said light-emitting diodes so that when both are energized the perceived color is the additive complement of said first and second output colors.

6. The status indicator of claim 5 including a breaker housing containing at least said breaker and said auxiliary switching system.

7. The status indicator of claim 6 wherein said diode housing is affixed to said breaker housing.

8. The status indicator of claim 6 wherein said diodes are affixed to said handle.

9. The status indicator of claim 4 wherein said auxiliary switching system and said network are configured for common excitation of said light diodes in one of said breaker switching by connecting said light-emitting diodes in parallel in reversed polarity with respect to said each other and by connecting said first and second light-emitting diodes network terminal means of through a capacitor of reactance value chosen to limit the current delivered to said light-emitting diodes.

10. A switching-condition-indicating status indicator a circuit breaker operable automatically upon overload to a tripped switching condition and including a first terminal adapted for connection to an input high-voltage line, a second terminal adapted for connection to one of a neutral line and an opposing phase high-voltage line, a load terminal adapted for connection to a load-feeding power line, and an actuator handle for resetting said breaker to a closed switching condition and thereafter between open and closed switching conditions, comprising:

an auxiliary switching system operably responsive to the switching condition of said breaker and operated to a first switching condition when said breaker is in said on condition, a second switching condition when breaker is in said tripped condition, and a third switching condition when said breaker is in said off condition, a pair of light-emitting diodes of different color output connected in parallel and in opposing polarities, said pair being connected at one end to said first terminal and at the other end to a network node, a capacitor connected between said second terminal and said network node, first and second rectifying diodes, said first rectifying diode having its anode connected to said first terminal, said second rectifying diode having its cathode connected to said first terminal, said switching system being configured to selectively connect the cathode of said first rectifying diode to said network node when said breaker is in one of said on and said off breaker switching conditions, to selectively connect the anode of said second rectifying diode to said node when said breaker is in the other of said on and said off breaker switching conditions, and to sever connection between said rectifying diodes and said node when said breaker is in said tripped switching condition.

11. A switching-condition-indicating status indicator for a circuit breaker operable automatically upon overload to a tripped switching condition and including a first terminal adapted for connection to an input high-voltage line, a second terminal adapted for connection to one of a neutral line and an opposing phase high-voltage line, a load terminal adapted for connection to a load-feeding power line, and an actuator handle for resetting said breaker to a closed switching condition and thereafter between open and closed switching conditions, said breaker being of the double-break type having a movable bridging contactor disposed to bridgingly connect first and second breaker contacts when in the on condition and to break connection to both breaker contacts when in the off and tripped conditions, said first breaker contact being connected to said first breaker terminal and said second breaker contact being connected to said breaker load terminal, said indicator comprising:

an auxiliary switch operably responsive to the switching condition of said breaker and operated to a closed switching condition when said breaker is in said on and said off conditions and to an open switching condition when said breaker is in said tripped condition;

a first light emitting diode having a given output color and connected in series with said auxiliary switch to connect the anode of said first light emitting diode to a first network node and the cathode of said first light emitting diode to said second breaker terminal;

a first capacitor connecting said first network node to said first breaker terminal;

a first rectifying diode having its anode, connected to said second breaker terminal and its cathode connected to said first network node;

a second light emitting diode having an output color different from said given color and having its cathode connected to said second breaker terminal and its anode connected to a second network node:

a second rectifying diode having its anode connected to said first network node and its cathode connected to said second network node; and a second capacitor connected between said bridging contactor and said second network node.

12. A switching-condition-indicating status indicator for a circuit breaker operable automatically upon overload to a tripped switching condition and including a first terminal adapted for connection to an input high-voltage line, a second terminal adapted for connection to one of a neutral line and an opposing phase high-voltage line, a load terminal adapted for connection to a load-feeding power line, and an actuator handle for resetting said breaker to a closed switching condition and thereafter between open and closed switching conditions, comprising:

a capacitor connected between said second breaker terminal and a network node;

a first switch operably responsive to the switching condition of said breaker and operated to a closed condition when said breaker is in said open and closed conditions and to an open condition when said breaker is in said tripped condition;

a rectifying diode connected through said first switch to said first breaker terminal and said network node;

a pair of light-emitting diodes of different color output connected in parallel and in opposing polarities; and a polarity reversing second switch connected to energize said pair of light emitting diodes from said first breaker terminal and said network node and operatively responsive to the switching condition of said breaker to be operated to a given polarity state when said breaker is in said on condition and to the opposite polarity state when said breaker is in said tripped and said off conditions.

* * * * *